US012098607B2

(12) United States Patent
Ritchie et al.

(10) Patent No.: US 12,098,607 B2
(45) Date of Patent: Sep. 24, 2024

(54) DOWNHOLE VIBRATION TOOL

(71) Applicant: Turbo Drill Industries, Inc., Conroe, TX (US)

(72) Inventors: Sheldon Ritchie, Conroe, TX (US); Mark Adam, Conroe, TX (US); Chad Feddema, Conroe, TX (US)

(73) Assignee: TURBO DRILL INDUSTRIES, INC., Conroe, TX (US)

( * ) Notice: Subject to any disclaimer, the term of this patent is extended or adjusted under 35 U.S.C. 154(b) by 108 days.

(21) Appl. No.: 17/987,967

(22) Filed: Nov. 16, 2022

(65) Prior Publication Data

US 2023/0151706 A1 May 18, 2023

Related U.S. Application Data

(60) Provisional application No. 63/279,967, filed on Nov. 16, 2021.

(51) Int. Cl.
*E21B 28/00* (2006.01)
*E21B 23/04* (2006.01)

(52) U.S. Cl.
CPC ..... *E21B 28/00* (2013.01); *E21B 23/0415* (2020.05); *E21B 23/0421* (2020.05)

(58) Field of Classification Search
CPC ..... E21B 7/24; E21B 17/07; E21B 23/0415; E21B 23/0421; E21B 23/0412;
(Continued)

(56) References Cited

U.S. PATENT DOCUMENTS 3,851,717 A * 12/1974 Berryman ..... E21B 31/113 175/297
3,955,634 A * 5/1976 Slator ..... E21B 31/113 175/297

(Continued)

FOREIGN PATENT DOCUMENTS

CN 104499941 A * 4/2015 ..... E21B 7/24
CN 111270995 A * 6/2020 ..... E21B 7/24

(Continued)

OTHER PUBLICATIONS

PCT International Search Report for related PCT Application No. PCT/US2022/050036, dated Mar. 29, 2023, 3 pages.

(Continued)

*Primary Examiner* — Jennifer H Gay
(74) *Attorney, Agent, or Firm* — Ewing & Jones, PLLC

(57) ABSTRACT

A downhole vibration tool includes a body, a mandrel, a spring, and a balance piston. The body may be generally tubular and may have one or more helical slots formed on an inner surface thereof. The mandrel may be generally tubular, may have a bore, and may be positioned at least partially within the body. The mandrel may have one or more helical splines formed on an outer surface of the mandrel, the helical splines engaging the helical slots of the body such that the mandrel is translatable axially relative to the body. The spring may be positioned in an annular space formed between the mandrel and the body defined as a spring chamber. The balance piston may be in an annular space formed between the mandrel and the body, wherein the balance piston separates an oil-filled chamber from an internal pressure chamber.

30 Claims, 14 Drawing Sheets

(58) Field of Classification Search
CPC .... E21B 28/00; E21B 31/113; E21B 31/1135; E21B 4/02; E21B 43/003
See application file for complete search history.

(56) References Cited

U.S. PATENT DOCUMENTS

| | | | | |
|---|---|---|---|---|
| 4,186,569 | A | 2/1980 | Aumann | |
| 4,518,888 | A * | 5/1985 | Zabcik | E21B 17/07 175/50 |
| 7,290,604 | B2 * | 11/2007 | Evans | E21B 31/1135 166/178 |
| 9,512,684 | B2 * | 12/2016 | Khaparde | E21B 17/07 |
| 10,508,496 | B2 * | 12/2019 | Kutinsky | E21B 34/06 |
| 11,220,866 | B2 * | 1/2022 | Donald | E21B 17/07 |
| 11,814,959 | B2 * | 11/2023 | Donald | E21B 28/00 |
| 2004/0140131 | A1 | 7/2004 | Susman | |
| 2005/0092484 | A1 * | 5/2005 | Evans | E21B 31/1135 166/178 |
| 2016/0230479 | A1 * | 8/2016 | Khaparde | E21B 17/07 |
| 2018/0163479 | A1 * | 6/2018 | Kutinsky | E21B 21/10 |
| 2018/0171719 | A1 * | 6/2018 | Donald | E21B 7/24 |
| 2022/0090449 | A1 * | 3/2022 | Donald | E21B 28/00 |
| 2023/0151706 | A1 * | 5/2023 | Ritchie | E21B 28/00 166/249 |

FOREIGN PATENT DOCUMENTS

| | | | | |
|---|---|---|---|---|
| CN | 113389492 | A * | 9/2021 | |
| WO | WO-2016057040 | A1 * | 4/2016 | E21B 31/113 |

OTHER PUBLICATIONS

PCT Written Opinion of the International Searching Authority for related PCT Application No. PCT/US2022/050036, dated Mar. 29, 2023, 6 pages.

* cited by examiner

DOWNHOLE VIBRATION TOOL

CROSS-REFERENCE TO RELATED APPLICATIONS

This application claims priority to, and the benefit of, U.S. Provisional Patent Application Ser. No. 63/279,967 filed on Nov. 16, 2021 and entitled "Downhole Vibration Tool", which is incorporated herein by referenced in its entirety.

TECHNICAL FIELD

The present disclosure relates generally to downhole tools for use in a wellbore, and specifically to tools for generating vibrations in a wellbore.

BACKGROUND

When drilling a wellbore, a drill string comprising a plurality of tubular members joined end to end may be fed through a wellbore. In certain circumstances, for example while drilling a deviated or horizontal wellbore, friction between the drill string and the wellbore may cause difficulty in inserting or removing the drill string from the wellbore. Friction reduction tools (FRT) or other hydraulically actuated tools may be used to generate friction reducing forces in the drill string to temporarily reduce friction between the drill string and the wellbore. Hydraulically actuated tools may be powered by pressure pulses of drilling fluid supplied through the drill string.

SUMMARY

The present disclosure provides for a downhole vibration tool. The downhole vibration tool includes a body. The body may be generally tubular. The body may have one or more helical slots formed on an inner surface thereof. The downhole vibration tool includes a mandrel, the mandrel being generally tubular. The mandrel may have a bore. The mandrel may be positioned at least partially within the body. The mandrel may have one or more helical splines formed on an outer surface of the mandrel, the helical splines engaging the helical slots of the body. The space between the body and the mandrel wherein the helical splines are located may define a spline chamber. The mandrel may be translatable axially relative to the body. The downhole vibration tool may include a spring positioned in an annular space formed between the mandrel and the body defined as a spring chamber. The downhole vibration tool may include a balance piston positioned in an annular space formed between the mandrel and the body, wherein the balance piston separates an oil-filled chamber from an internal pressure chamber. The internal pressure chamber may be fluidly coupled to the bore of the mandrel by a balance port. The balance piston may be movable axially relative to the mandrel and the body wherein the oil filled chamber, spring chamber, and spline chamber are fluidly coupled.

The present disclosure provides for a system. The system may include a drill string, the drill string having a bore. The system may include a downhole vibration tool. The downhole vibration tool includes a body. The body may be generally tubular. The body may have one or more helical slots formed on an inner surface thereof. The body may be coupled to the drill string. The downhole vibration tool includes a mandrel, the mandrel being generally tubular. The mandrel may have a bore fluidly coupled to the bore of the drill string. The mandrel may be positioned at least partially within the body. The mandrel may have one or more helical splines formed on an outer surface of the mandrel, the helical splines engaging the helical slots of the body. The space between the body and the mandrel wherein the helical splines are located may define a spline chamber. The mandrel may be translatable axially relative to the body. The downhole vibration tool may include a spring positioned in an annular space formed between the mandrel and the body defined as a spring chamber. The downhole vibration tool may include a balance piston positioned in an annular space formed between the mandrel and the body, wherein the balance piston separates an oil-filled chamber from an internal pressure chamber. The internal pressure chamber may be fluidly coupled to the bore of the mandrel by a balance port. The balance piston may be movable axially relative to the mandrel and the body wherein the oil filled chamber, spring chamber, and spline chamber are fluidly coupled. The system may include a pressure pulsation tool. The pressure pulsation tool may be adapted to generate pulses within the bore of the drill string in response to fluid flow through the drill string.

The present disclosure provides for a method. The method may include coupling a downhole vibration tool to a drill string. The downhole vibration tool may include a body. The body may be generally tubular. The body may have one or more helical slots formed on an inner surface thereof. The body may be coupled to the drill string. The downhole vibration tool may include a mandrel. The mandrel may be generally tubular. The mandrel may have a bore fluidly coupled to the bore of the drill string. The mandrel may be positioned at least partially within the body. The mandrel may have one or more helical splines formed on an outer surface of the mandrel. The helical splines may engage the slots of the body. The space between the body and the mandrel wherein the helical splines are located may define a spline chamber. The mandrel may be translatable axially relative to the body. The mandrel may include a piston. The piston may be positioned in an annular space between the mandrel and the body defined as an actuation chamber. The piston may divide the actuation chamber into an external pressure actuation chamber and an internal pressure actuation chamber, wherein the body comprises an external port formed therein that fluidly couples the external pressure actuation chamber to the exterior of the body and wherein the internal pressure actuation chamber is fluidly coupled to the pressure within the bore of the mandrel. The downhole vibration tool may include a spring. The spring may be positioned in an annular space formed between the mandrel and the body defined as a spring chamber. The downhole vibration tool may include a balance piston. The balance piston may be positioned in an annular space formed between the mandrel and the body, wherein the balance piston separates an oil-filled chamber from an internal pressure chamber. The internal pressure chamber may be fluidly coupled to the bore of the mandrel by a balance port. The balance piston may be movable axially relative to the mandrel and the body wherein the oil filled chamber, spring chamber, and spline chamber are fluidly coupled. The method may include positioning the downhole vibration tool within a wellbore. The method may include increasing the pressure within the bore of the mandrel. The method may include imparting a differential pressure between the internal pressure actuation chamber and the external pressure actuation chamber across the piston, The method may include generating a longitudinal extension force and torsional force on the mandrel relative to the body. The method may include helically extending the mandrel relative to the body.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
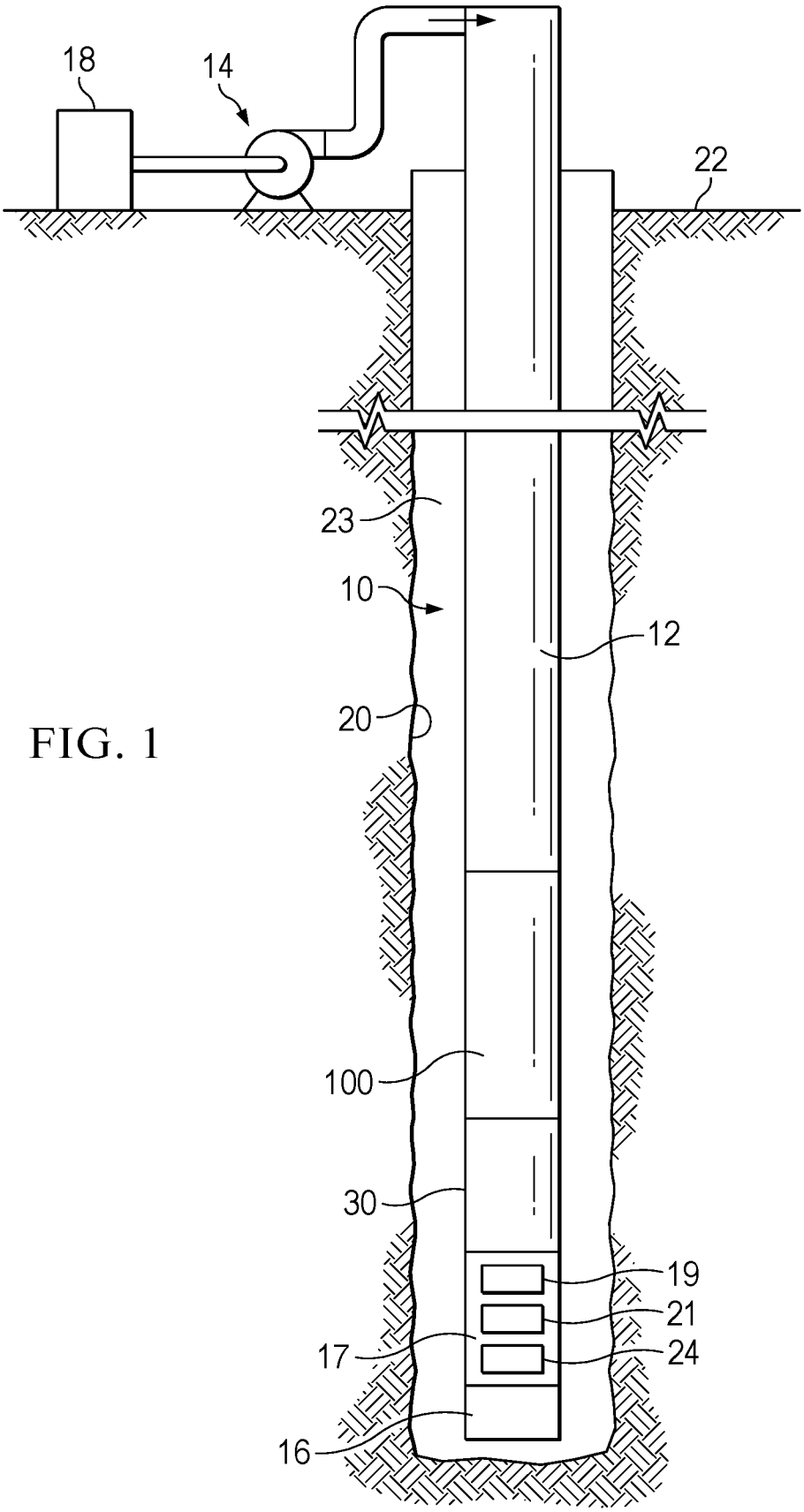
FIG. 1 depicts an overview of a drill string having a downhole vibration tool consistent with at least one embodiment of the present disclosure in a wellbore.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drill string 10 positioned within wellbore 20. Drill string 10 may include downhole vibration tool 100. Drill string 10 may be constructed from a plurality of tubular components that together define drill string bore 12. Wellbore annulus 23 may be defined as the annular space within wellbore 20 about drill string 10. One or more pumps 14 may be positioned to pump fluid through drill string bore 12. Pumps 14 may be controlled by controller 18 so as to provide different flow rates of fluid through drill string bore 12. For the purposes of this disclosure, "up", "above", and "upper" denote a direction within wellbore 20 toward the surface 22, and "down", "below", and "lower" denote a direction within wellbore 20 away from the surface 22.

In some embodiments, drill string 10 may include bottom hole assembly (BHA) 17. In some embodiments, BHA 17 may include, for example and without limitation, one or more of drill bit 16, MWD system 19, downhole motor 21, rotary steerable system 24, or other downhole tools.

In some embodiments, drill string 10 may include downhole vibration tool 100. Downhole vibration tool 100 may be positioned at or near BHA 17 as shown in FIG. 1 or may be positioned at any other point along drill string 10. Drill string 10 may include pressure pulsation tool 30. Pressure pulsation tool 30 may generate pressure pulses within drill string bore 12 in response to fluid flow through drill string 10 from pumps 14. For the purposes of this disclosure, internal pressure refers to the pressure within drill string bore 12, external pressure refers to the pressure within wellbore annulus 23, and differential pressure refers to the difference between internal pressure and external pressure unless otherwise denoted. Pressure pulsation tool 30 may be positioned above or below downhole vibration tool 100.

Figure 2:
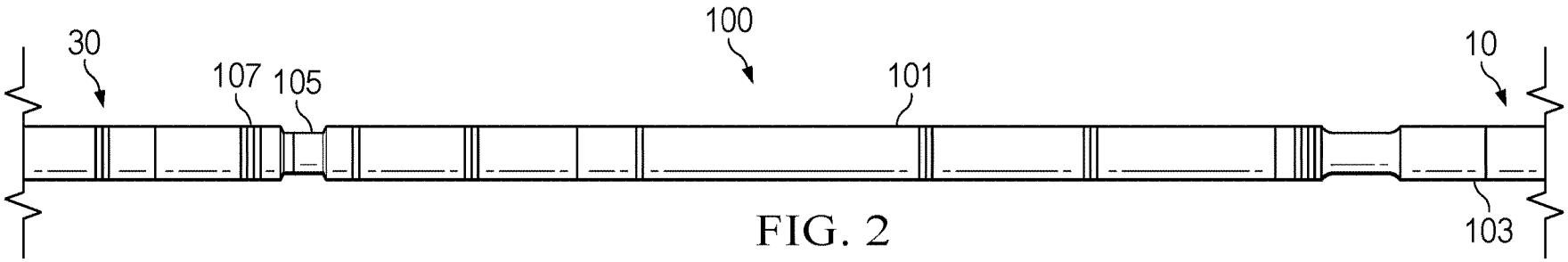
FIG. 2 depicts a side elevation view of a downhole vibration tool consistent with at least one embodiment of the present disclosure.
Figure 3:
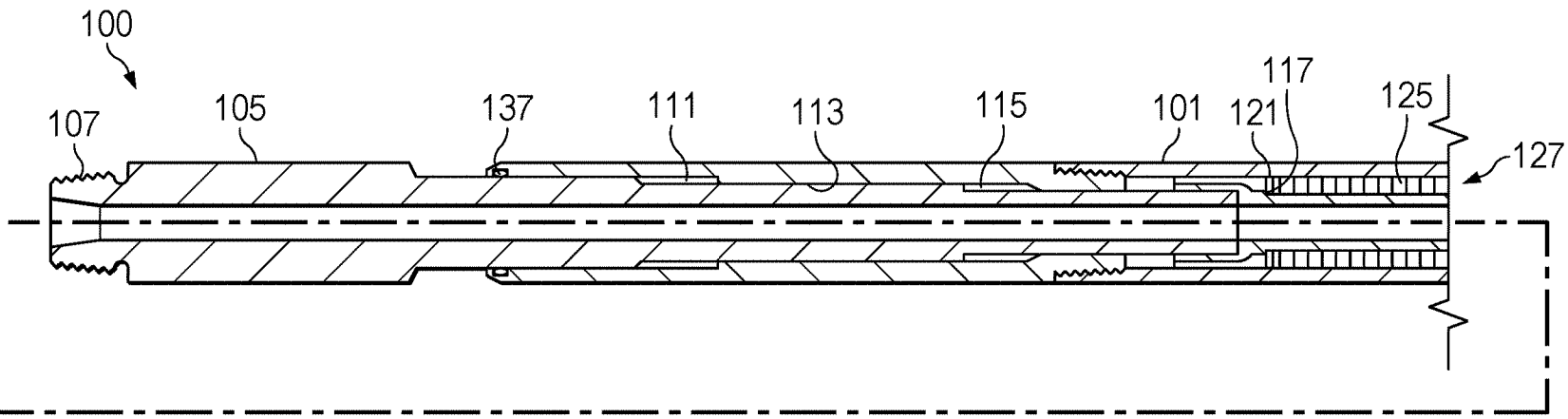
FIG. 3 depicts a cross section view of a downhole vibration tool consistent with at least one embodiment of the present disclosure.
Figure 3:
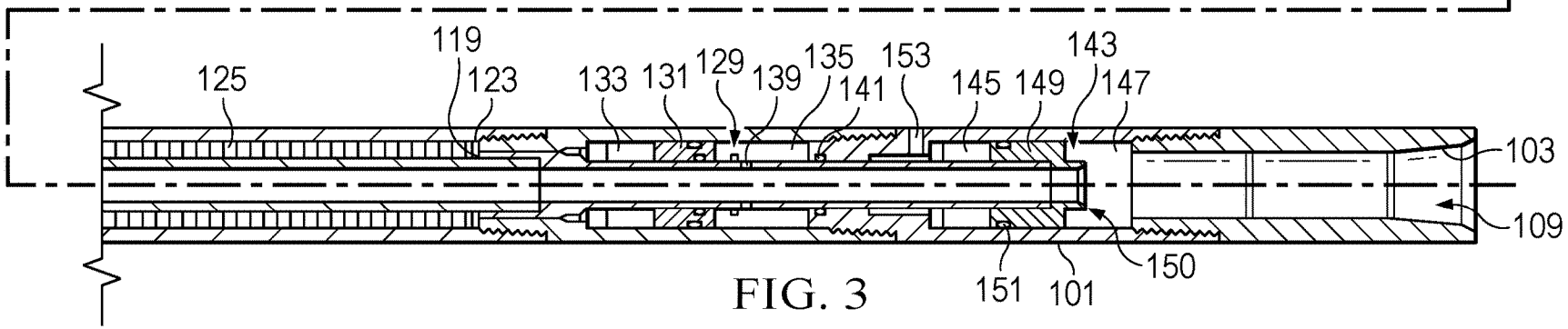

In some embodiments, as shown in FIGS. 2, 3, downhole vibration tool 100 may include body 101. Body 101 may be generally tubular. In some embodiments, body 101 may include first coupler 103 positioned at an end of body 101 to allow downhole vibration tool 100 to couple to drill string 10 or other tools of drill string 10. In some embodiments, downhole vibration tool 100 may include mandrel 105. Mandrel 105 may be tubular and may be positioned at least partially within body 101. In some embodiments, mandrel 105 may include second coupler 107 positioned at an end of mandrel 105 opposite body 101 and adapted to allow downhole vibration tool 100 to couple to pressure pulsation tool 30 or other tools of drill string 10. In some embodiments, body 101 and mandrel 105 may be tubular and may define tool bore 109. In some embodiments, the annular space between mandrel 105 and body 101 may form one or more chambers as discussed below.

Figure 4:
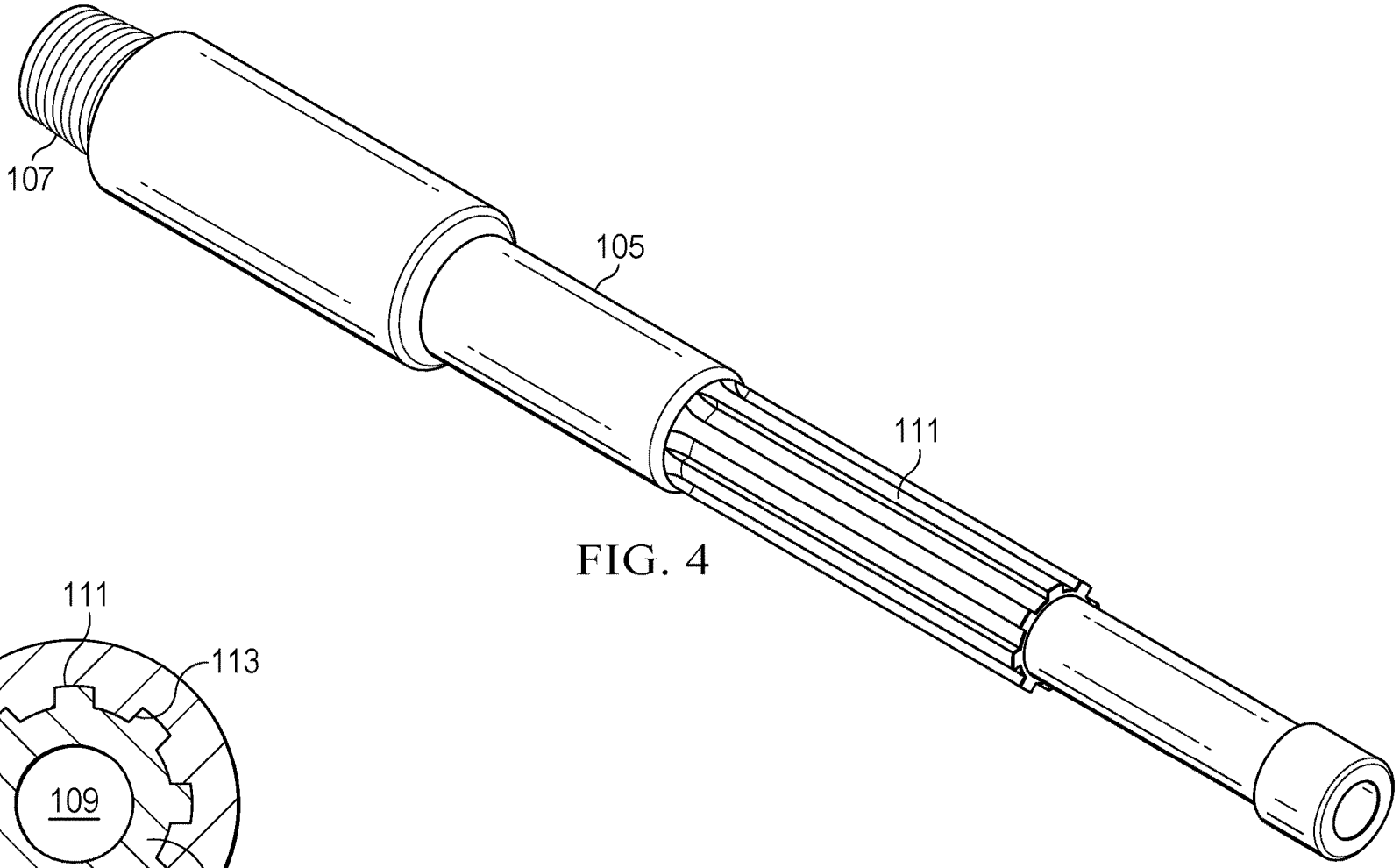
FIG. 4 depicts a perspective view of a mandrel of the downhole vibration tool of FIG. 3.
Figure 5:
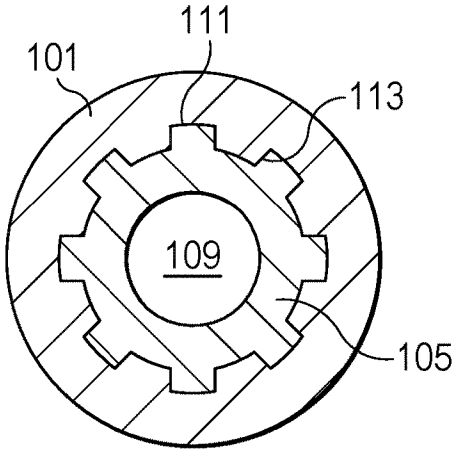
FIG. 5 depicts a cross section view of the downhole vibration tool of FIG. 3 taken at line A-A.

In some embodiments, with respect to FIGS. 4, 5, mandrel 105 may include one or more splines 111. Splines 111 may engage with slots 113 formed on an inner surface of body 101 as shown in FIG. 5. The engagement of splines 111 with slots 113 may allow for longitudinal motion of mandrel 105 relative to body 101 while transmitting torque between body 101 and mandrel 105. In some embodiments, with reference to FIG. 3, the area within body 101 within which splines 111 and slots 113 are located may define spline chamber 115.

In some embodiments, with reference to FIG. 3, mandrel 105 may include lower mandrel spring stop 117 and upper mandrel spring stop 119. Body 101 may correspondingly include lower body spring stop 121 and upper body spring stop 123. Spring 125 may be positioned about mandrel 105 within body 101 between lower mandrel spring stop 117 lower body spring stop 121 and upper mandrel spring stop 119 and upper body spring stop 123. Spring 125 may, for example and without limitation, be one or more of a coil spring or Belleville spring. Spring 125 may operate such that longitudinal movement of mandrel 105 relative to body 101 causes compression of spring 125 in both directions, such that spring 125 biases mandrel 105 to a neutral position as shown in FIG. 3. In some embodiments, the area within body 101 within which spring 125 is located may define spring chamber 127.

In some embodiments, downhole vibration tool 100 may include balance piston chamber 129. Balance piston chamber 129 may be formed in an annular space between mandrel 105 and body 101. In some embodiments, balance piston 131 may be positioned within balance piston chamber 129 and may be fluidly sealed against mandrel 105 and body 101. In some embodiments, balance piston 131 may divide balance piston chamber 129 into two chambers, referred to herein as oil-filled chamber 133 and internal pressure chamber 135. Balance piston 131 may be able to move longitudinally within balance piston chamber 129 due to force applied on balance piston 131 maintaining an approximately equal pressure differential between oil-filled chamber 133 and internal pressure chamber 135. In some embodiments, balance piston 131 may, by moving longitudinally within balance piston chamber 129, transfer internal pressure from internal pressure chamber 135 to oil-filled chamber 133 such that the pressure in oil-filled chamber 133 is approximately equal to the pressure in internal pressure chamber 135.

In some embodiments, oil-filled chamber 133 may be fluidly coupled to spring chamber 127 and spline chamber 115. In some such embodiments, oil-filled chamber 133, spring chamber 127, and spline chamber 115 may be filled with oil. In some embodiments, one or more seals may be positioned between mandrel 105 and body 101 such that oil-filled chamber 133, spring chamber 127, and spline chamber 115 are fluidly isolated from other chambers of downhole vibration tool 100 and the surrounding wellbore by, for example and without limitation, mandrel seal 137.

In some embodiments, internal pressure chamber 135 may be fluidly coupled to the bore of mandrel 105 by balance ports 139. Internal pressure chamber 135 may thereby remain at or substantially at internal pressure. In some embodiments, internal pressure chamber 135 may be fluidly isolated from other chambers of downhole vibration tool 100 and the surrounding wellbore by, for example and without limitation, body seal 141.

In some embodiments, downhole vibration tool 100 may include actuation chamber 143. Actuation chamber 143 may be divided into external pressure actuation chamber 145 and internal pressure actuation chamber 147 by piston 149. Piston 149 may be mechanically coupled to mandrel 105 and may be fluidly sealed against body 101 by piston seal 151. In some embodiments, external pressure actuation chamber 145 may be fluidly coupled to wellbore annulus 23 by one or more external ports 153 formed in body 101 and may therefore be at external pressure. Internal pressure actuation chamber 147 may be at internal pressure directly.

Figure 6:
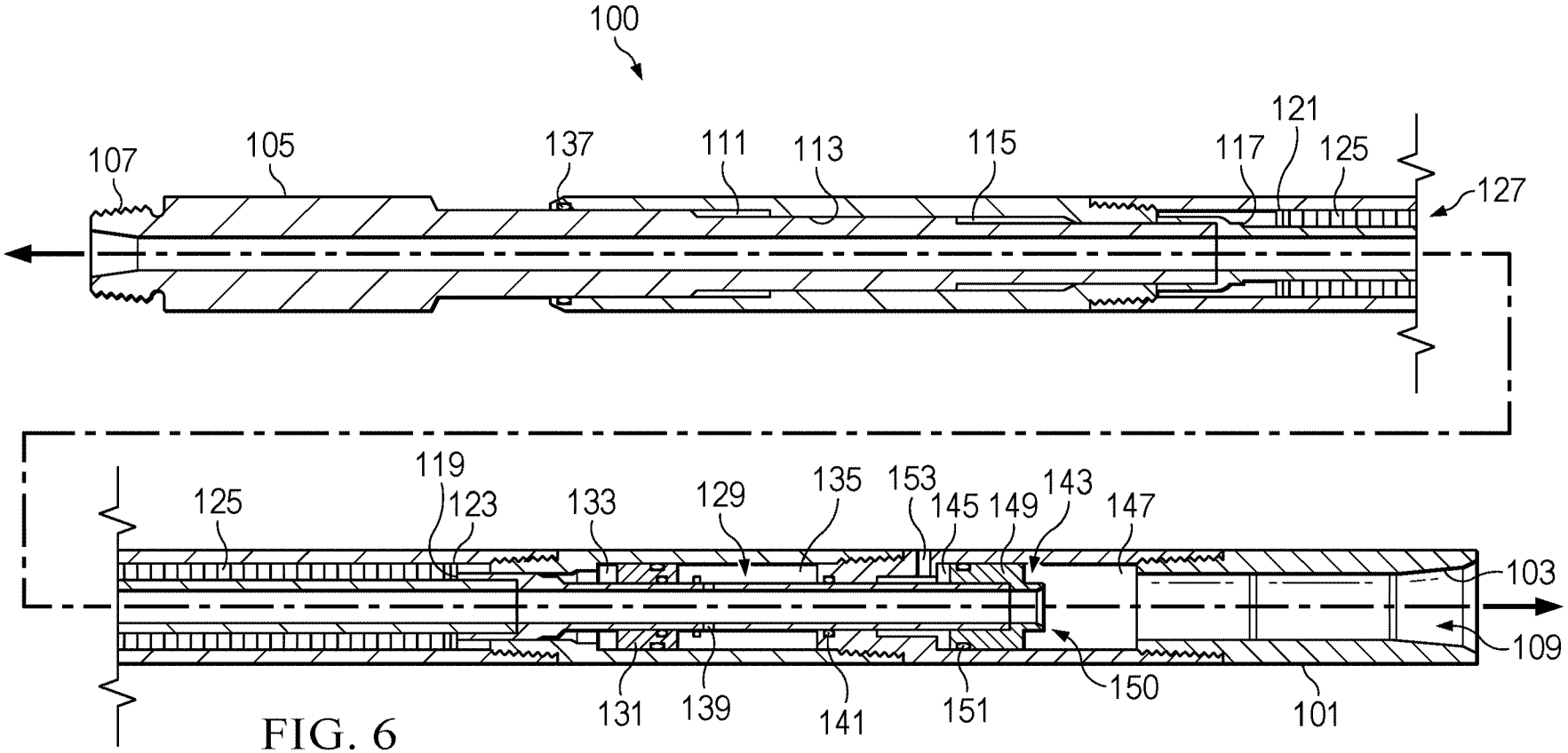
FIG. 6 depicts a cross section view of the downhole vibration tool of FIG. 3 in an extended position.
Figure 6A:
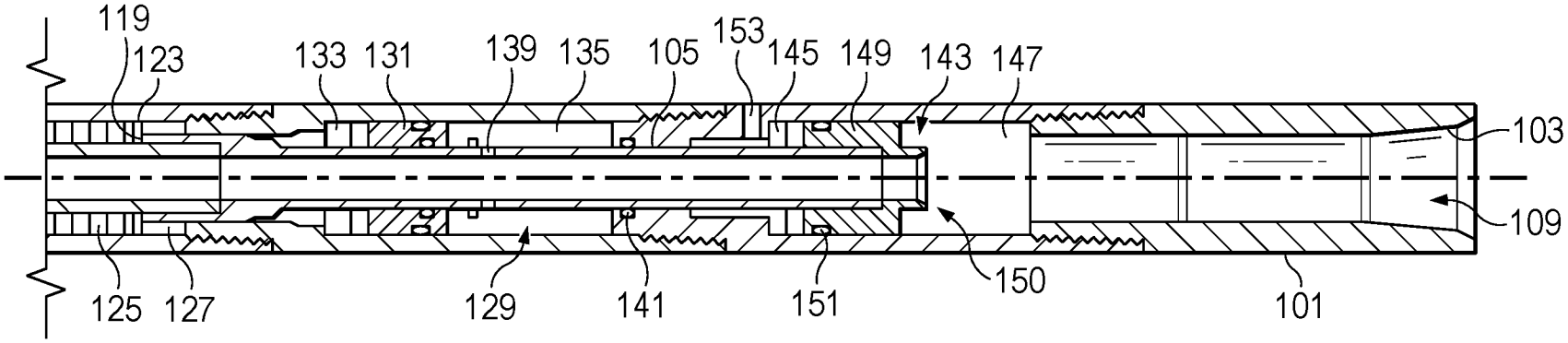
FIG. 6A depicts a detail view of FIG. 6.

Because piston 149 is mechanically coupled to mandrel 105, differential pressure acting across piston 149 due to the difference between internal pressure and external pressure may result in a force acting on piston 149 referred to herein as an extending force. The internal pressure may act on pump-open area 150 of piston 149. Where the internal pressure is above the external pressure, the extending force may bias mandrel 105 into an extended position as shown in FIGS. 6 and 6A. As mandrel 105 extends, the extending force may act against spring 125, such that spring 125 is compressed between lower body spring stop 121 and upper mandrel spring stop 119. In some embodiments, the extension of mandrel 105 due to the positive pressure differential or, for example and without limitation, where drill bit 16 is out of contact with the formation may damp axial tensile forces extending through downhole vibration tool 100.

Figure 7:
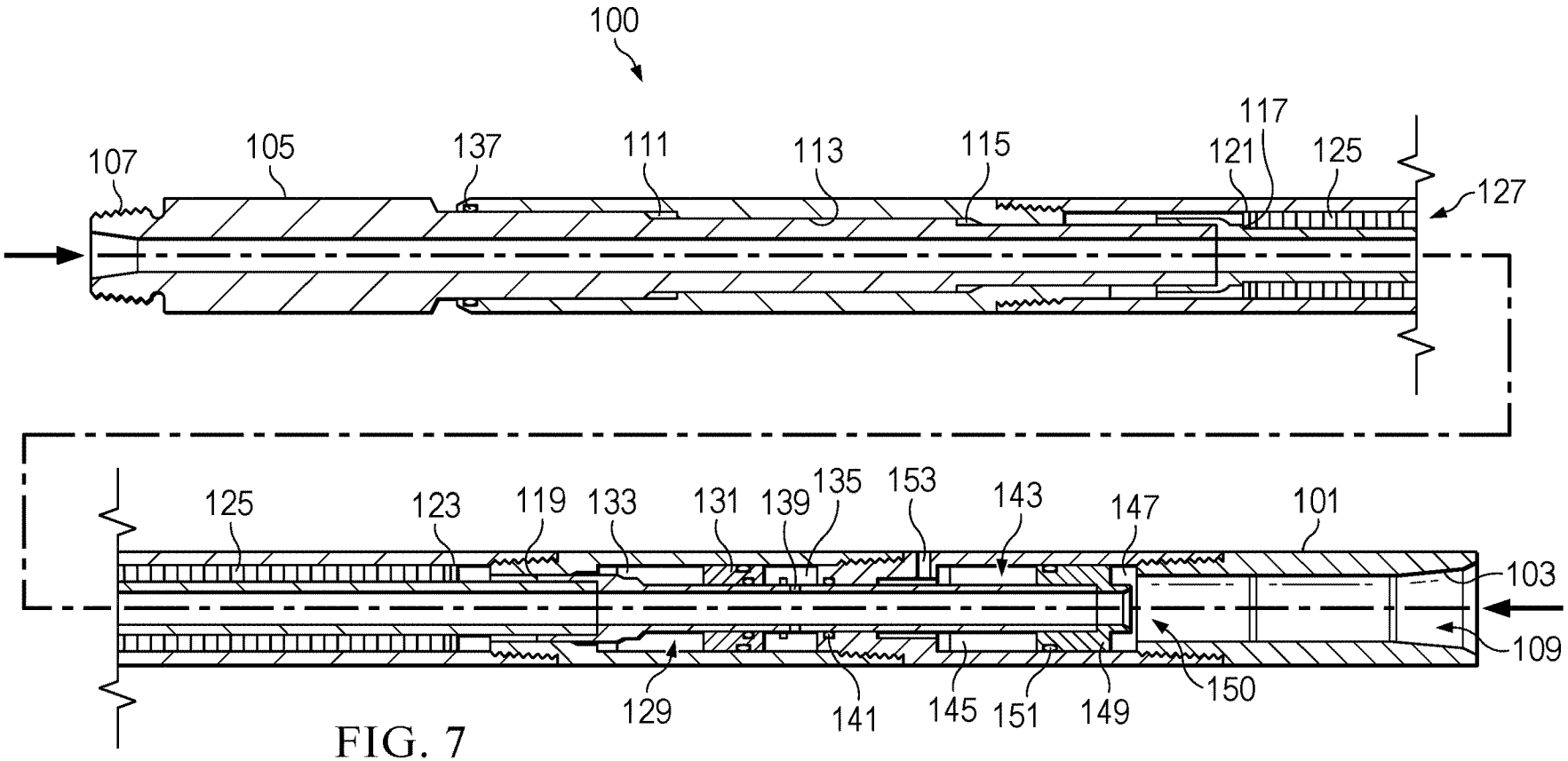
FIG. 7 depicts a cross section view of the downhole vibration tool of FIG. 3 in a retracted position.
Figure 7A:
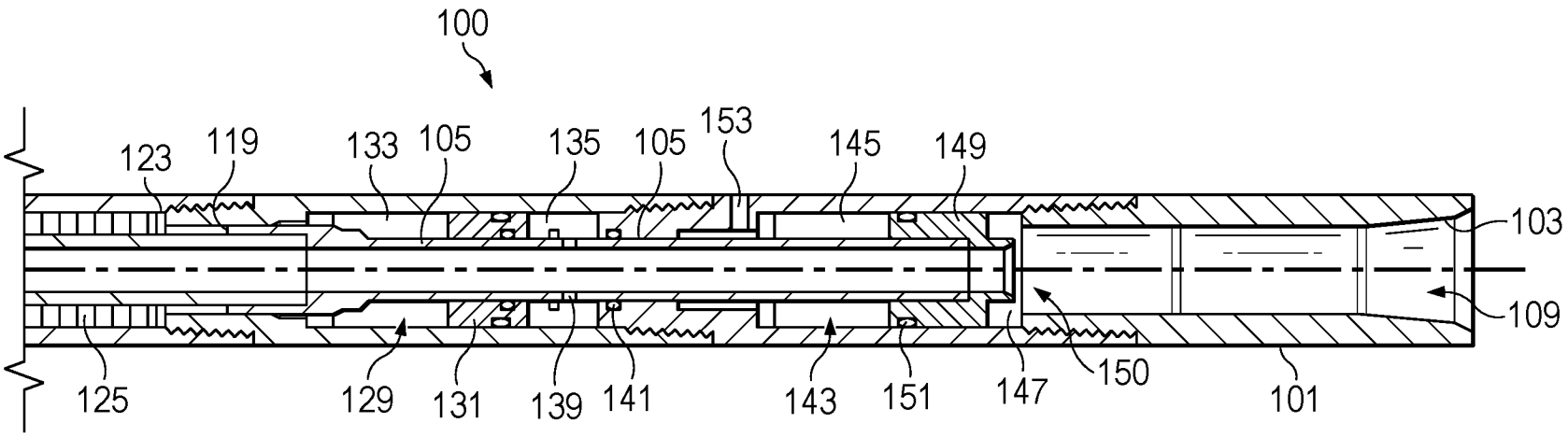
FIG. 7A depicts a detail view of FIG. 7.
Figure 8:
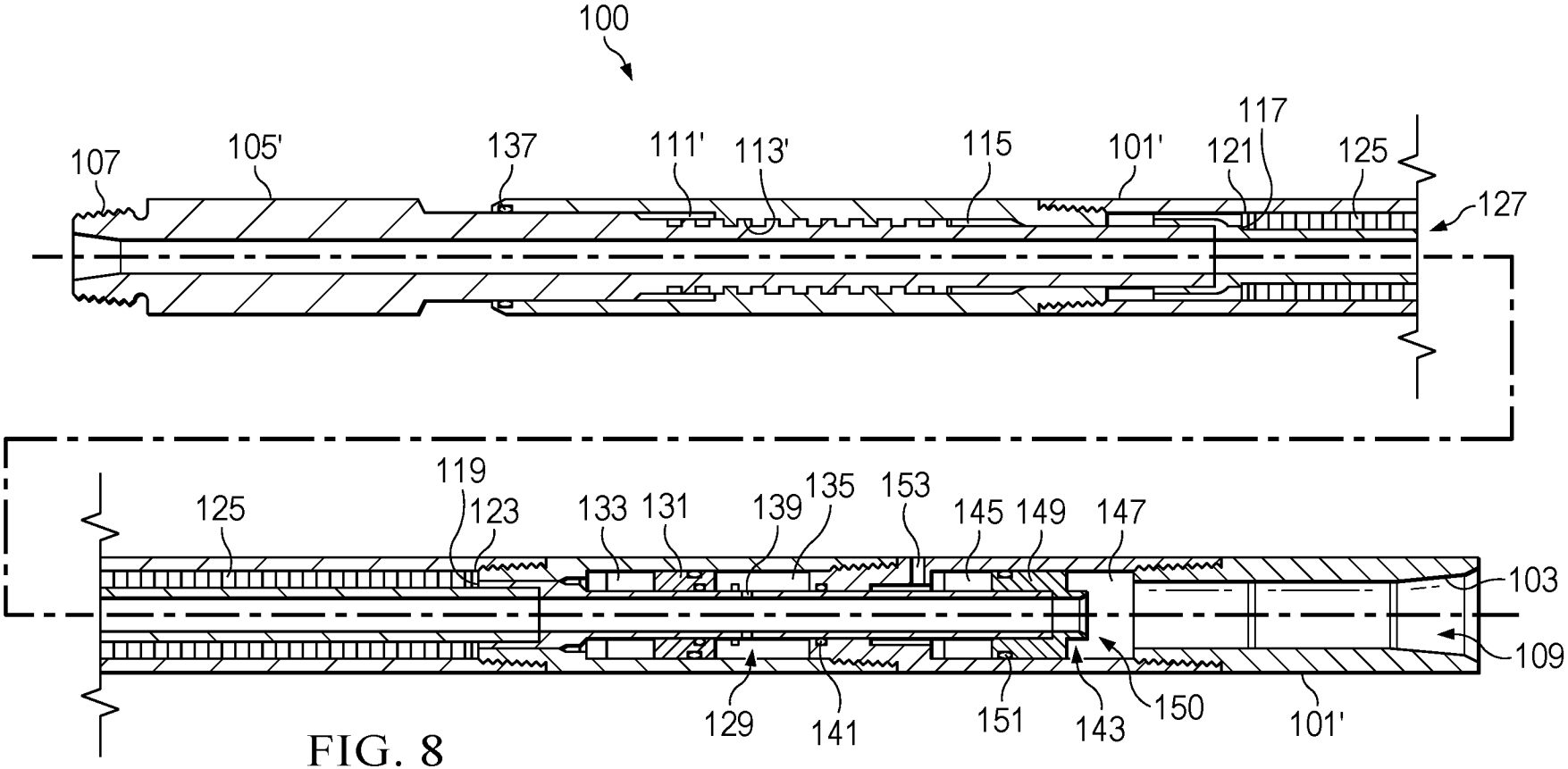
FIG. 8 depicts a cross section view of a downhole vibration tool consistent with at least one embodiment of the present disclosure.
Figure 9:
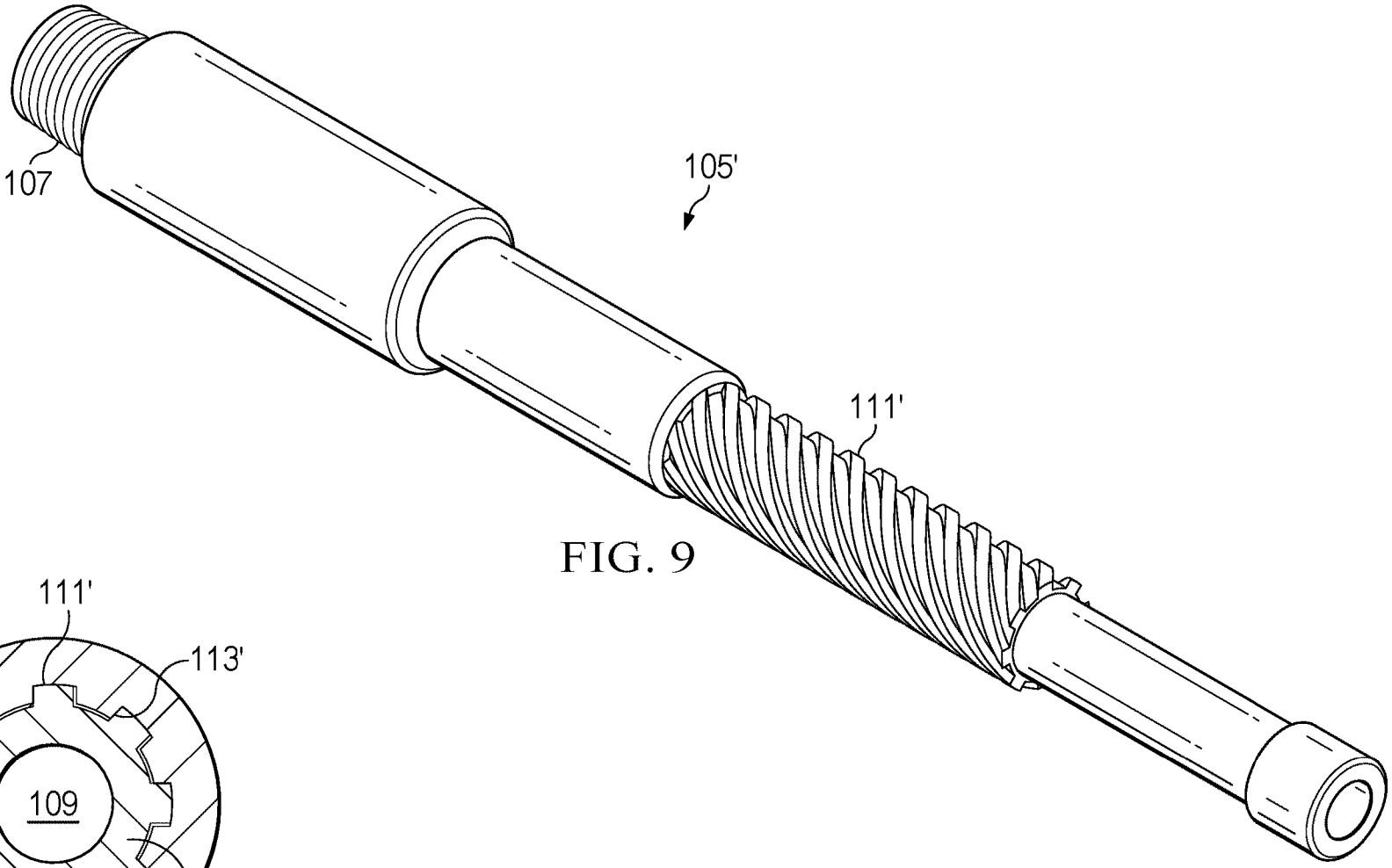
FIG. 9 depicts a perspective view of a mandrel of the downhole vibration tool of FIG. 8.
Figure 10:
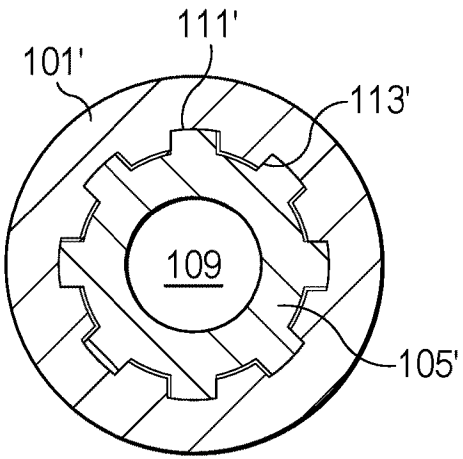
FIG. 10 depicts a cross section view of the downhole vibration tool of FIG. 8 taken at line B-B.
Figure 11:
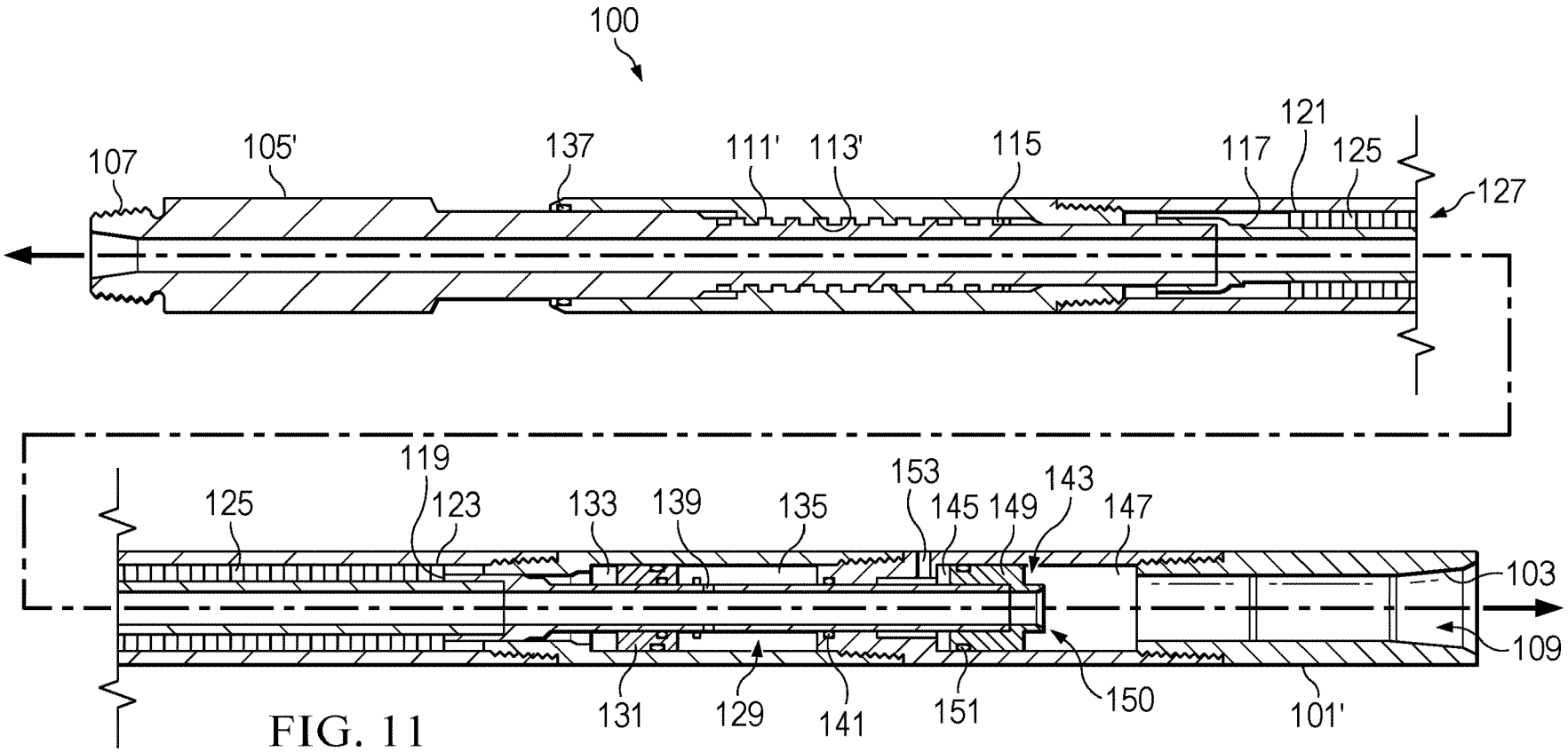
FIG. 11 depicts a cross section view of the downhole vibration tool of FIG. 8 in an extended position.
Figure 12:
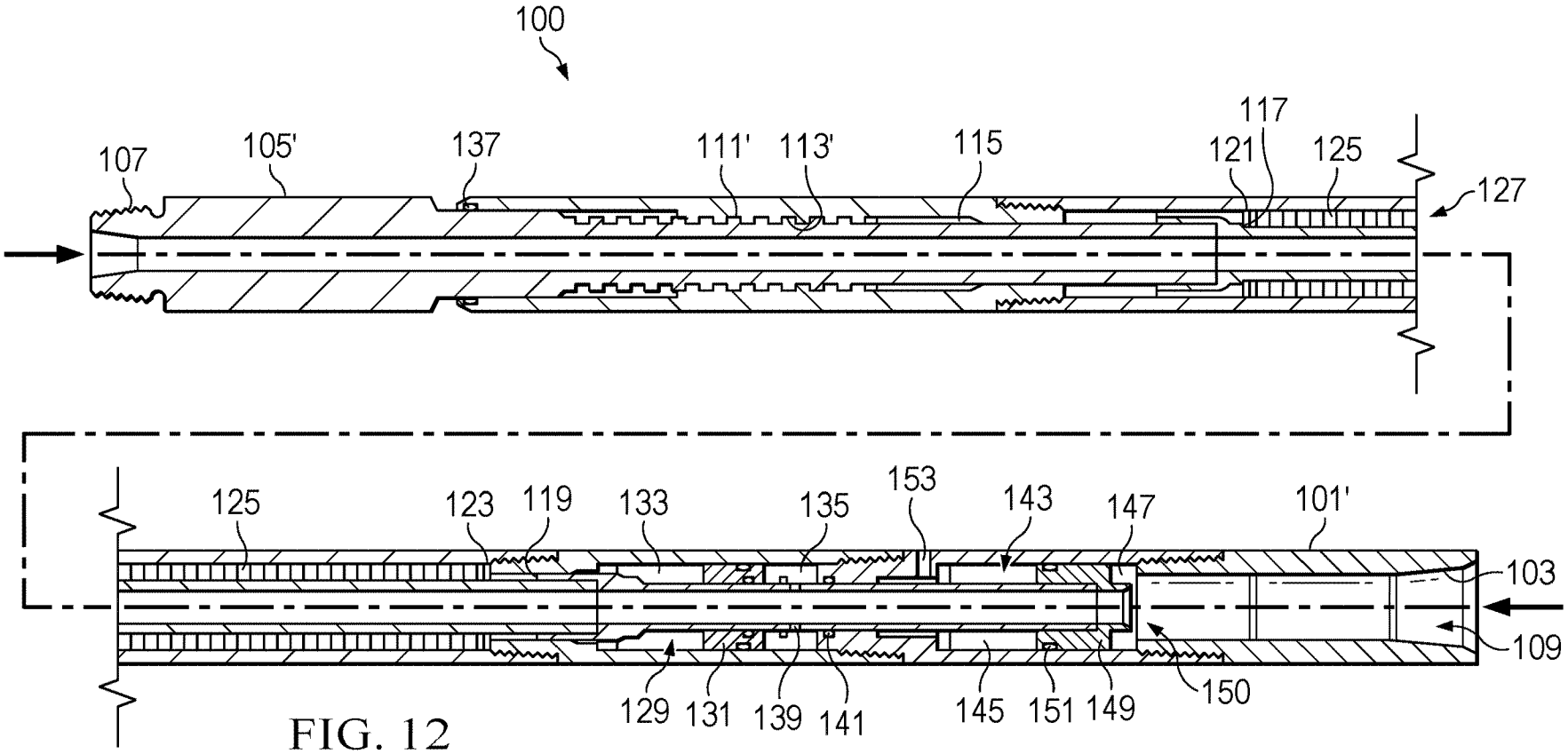
FIG. 12 depicts a cross section view of the downhole vibration tool of FIG. 8 in a retracted or compressed position.

In some embodiments, with reference to FIG. 1, the downward force exerted between drill string 10 and the bottom of wellbore 20, known as weight-on-bit, may be transmitted at least partially through downhole vibration tool 100. This weight may therefore exert a compressive force across downhole vibration tool 100. The compressive force may tend to bias mandrel 105 to retract into body 101 as shown in FIGS. 7, 7A. The compressive force may act against spring 125, such that spring 125 is compressed between upper body spring stop 123 and lower mandrel spring stop 117. In some embodiments, the retraction of mandrel 105 due to increases in compressive force may damp axial forces extending through downhole vibration tool 100.

In some embodiments, the amount of extension or retraction of mandrel 105 may be determined by the differential pressure, the cross-sectional area of piston 149, the strength and geometry of spring 125, the pump open force, and the compressive force acting on downhole vibration tool 100. As mandrel 105 extends or is retracted, the length of downhole vibration tool increases or decreases accordingly. This extension and retraction may, for example and without limitation, be used to generate vibrations in drill string 10 in both tension and compression in response to pressure pulses generated by pressure pulsation tool 30. Vibrations may be used, for example and without limitation, to allow for the drilling of horizontal or highly deviated wells in which drill string 10 may otherwise be subject to sticking during rotary or sliding-mode drilling operations. In some embodiments, the pressure pulses and thus the vibration induced by downhole vibration tool 100 may be generated at, for example and without limitation, between 4 Hz and 20 Hz. In some embodiments, the pressure pulses generated by pressure pulsation tool 30 may be, for example and without limitation, between 200 and 600 psi above the baseline internal pressure.

In some embodiments, as mandrel 105 is extended or retracted, the volume of spline chamber 115 and spring chamber 127 may change. To account for this change in volume, balance piston 131 may move within balance piston chamber 129, such that the total volume of oil-filled chamber 133, spring chamber 127, and spline chamber 115 remains constant and substantially at internal pressure due to internal pressure chamber 135 being fluidly coupled to the bore of mandrel 105 by balance ports 139.

In some embodiments, as shown in FIGS. 3-6, 6A, 7, and 7A, splines 111 and slots 113 may be formed substantially longitudinally along mandrel 105 and body 101, respectively. In such an embodiment, changes in differential pressure and compressive force may cause mandrel 105 to extend axially relative to body 101, such that axial vibrations are produced in response to pressure pulses.

In other embodiments, as shown in FIG. 8-12, splines 111' and slots 113' may be formed helically along mandrel 105' and body 101'. In such an embodiment, extension or retraction of mandrel 105' may both elongate downhole vibration tool 100 and exert a torsional force on drill string 10. Additionally, vibrations produced in response to pressure pulses generated by pressure pulsation tool 30 may cause both axial and torsional vibration of drill string 10 due to the helical motion of mandrel 105' relative to body 101', which may further reduce friction on drill string 10. In some such embodiments, downhole vibration tool 100 may operate as a torsional absorber while included in drill string 10 when pressure pulsation tool 30 is not engaged. In such an embodiment, both torsional loads and axial loads acting on drill string 10 across downhole vibration tool 100 may be absorbed by the resulting extension or retraction of mandrel 105'.

In some embodiments, as discussed above, downhole vibration tool 100 may include a single piston 149 in a single actuation chamber 143 having pump open area 150. In other embodiments, downhole vibration tool 100 may include multiple pistons and actuation chambers to, without being bound to theory, increase the longitudinal force imparted by the pressure differential by increasing the overall pump open area above that of pump open area 150.

Figure 13:
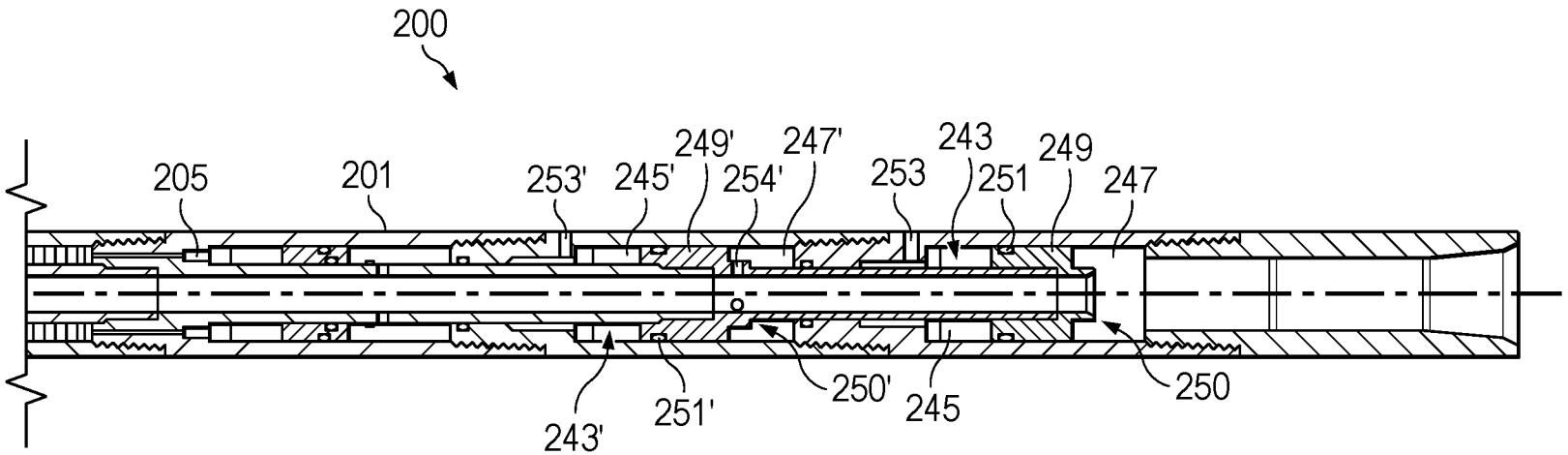
FIG. 13 depicts a detail cross section view of a downhole vibration tool consistent with at least one embodiment of the present disclosure.

For example, FIG. 13 depicts downhole vibration tool 200 that includes first piston 249 coupled to mandrel 205 positioned in first actuation chamber 243 formed between mandrel 205 and body 201. First actuation chamber 243 may be divided into first external pressure actuation chamber 245 and first internal pressure actuation chamber 247 by first piston 249. First piston 249 may be mechanically coupled to mandrel 205 and may be fluidly sealed against body 201 by first piston seal 251. In some embodiments, first external pressure actuation chamber 245 may be fluidly coupled to wellbore annulus 23 by one or more first external ports 253 formed in body 201 and may therefore be at external pressure. First internal pressure actuation chamber 247 may be at internal pressure and may act directly on pump open area 250 of first piston 249.

Downhole vibration tool 200 may further include second piston 249' coupled to mandrel 205 positioned in second actuation chamber 243' formed between mandrel 205 and body 201. Second actuation chamber 243' may be divided into second external pressure actuation chamber 245' and second internal pressure actuation chamber 247' by second piston 249'. Second piston 249' having pump open area 250' may be mechanically coupled to mandrel 205 and may be fluidly sealed against body 201 by second piston seal 251'. In some embodiments, second external pressure actuation chamber 245' may be fluidly coupled to wellbore annulus 23 by one or more second external ports 253' formed in body 201 and may therefore be at external pressure. Second internal pressure actuation chamber 247' may be fluidly coupled to the bore of mandrel 205 by internal ports 254' and may therefore be at internal pressure.

By including second piston 249' in addition to first piston 249, the cross-sectional area against which the differential pressure may act may be increased, such that a greater extension force may act on downhole vibration tool 200 for a given differential pressure as compared to an embodiment of a downhole vibration tool that includes only a single piston 149, such as shown and discussed with respect to downhole vibration tool 100.

Figure 14:
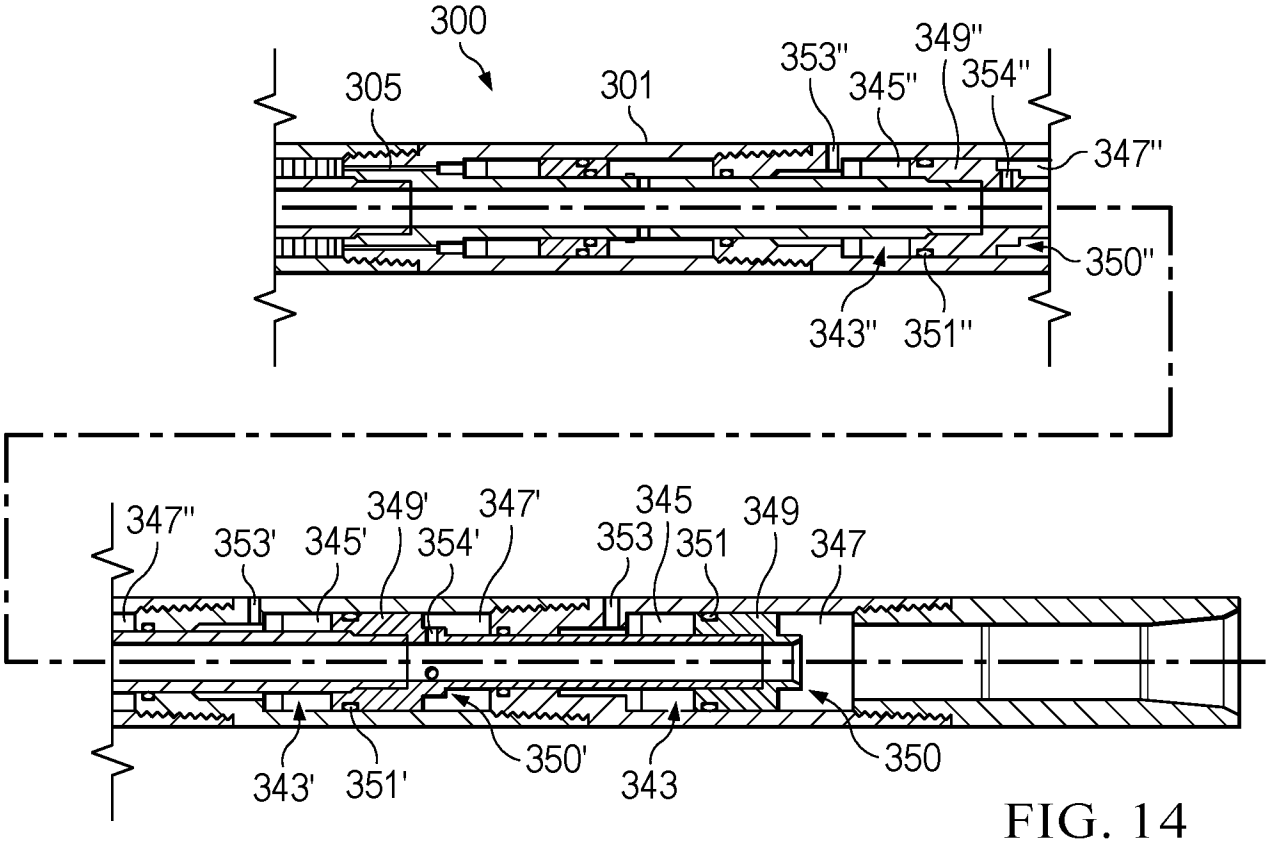
FIG. 14 depicts a detail cross section view of a downhole vibration tool consistent with at least one embodiment of the present disclosure.

In other embodiments, additional pistons may be included. For example, FIG. 14 depicts downhole vibration tool 300 that includes first piston 349 coupled to mandrel 305 positioned in first actuation chamber 343 formed between mandrel 305 and body 301. First actuation chamber 343 may be divided into first external pressure actuation chamber 345 and first internal pressure actuation chamber 347 by first piston 349. First piston 349 may be mechanically coupled to mandrel 305 and may be fluidly sealed against body 301 by first piston seal 351. In some embodiments, first external pressure actuation chamber 345 may be fluidly coupled to wellbore annulus 23 by one or more first external ports 353 formed in body 301 and may therefore be at external pressure. First internal pressure actuation chamber 347 may be at internal pressure directly.

Downhole vibration tool 300 may further include second piston 349' coupled to mandrel 305 positioned in second actuation chamber 343' formed between mandrel 305 and body 301. Second actuation chamber 343' may be divided into second external pressure actuation chamber 345' and second internal pressure actuation chamber 347' by second piston 349' having pump open area 350'. Second piston 349' may be mechanically coupled to mandrel 305 and may be fluidly sealed against body 301 by second piston seal 351'. In some embodiments, second external pressure actuation chamber 345' may be fluidly coupled to wellbore annulus 23 by one or more second external ports 353' formed in body 301 and may therefore be at external pressure. Second internal pressure actuation chamber 347' may be fluidly coupled to the bore of mandrel 305 by internal ports 354' and may therefore be at internal pressure.

Downhole vibration tool 300 may further include third piston 349" coupled to mandrel 305 positioned in third actuation chamber 343" formed between mandrel 305 and body 301. Third actuation chamber 343" may be divided into third external pressure actuation chamber 345" and third internal pressure actuation chamber 347" by third piston 349" having pump open area 350". Third piston 349" may be mechanically coupled to mandrel 305 and may be fluidly sealed against body 301 by third piston seal 351". In some embodiments, third external pressure actuation chamber 345" may be fluidly coupled to wellbore annulus 23 by one or more third external ports 353" formed in body 301 and may therefore be at external pressure. Third internal pressure actuation chamber 347" may be fluidly coupled to the bore of mandrel 305 by internal ports 354" and may therefore be at internal pressure.

By including third piston 349" in addition to first piston 349 and second piston 349", the cross-sectional area against which the differential pressure may act may be increased, such that a greater extension force may act on downhole vibration tool 300 for a given differential pressure as compared to an embodiment of a downhole vibration tool that includes only a single piston 149, such as shown and discussed with respect to downhole vibration tool 100, or an embodiment of a downhole vibration tool that includes two pistons 249, 249' such as shown and discussed with respect to downhole vibration tool 200.

Adding additional pistons may, for example and without being bound to theory, increase total pump open area which when subject to a positive pressure differential and may increase the extension force. Such an increase in extension force may, when subject to positive pressure differential pulses, generate vibrations of stronger force. However, should the extension force exceed the maximum operating limits of spring 125, such as to fully compress spring 125, axial stroking movement may be prevented or reduced, which may prevent or reduce vibrations. Should downhole vibration tool 100 be configured in a rotary application such that drilling torque is transferred through helical splines 111', the drilling torque may generate a compressive jacking force which may be transferred to spring 125, which may allow additional pistons to be installed, increasing total pump open area to generate increased extension vibration force whilst operating within limits of spring 125.

Alternatively, with relation to rotary applications comparing a straight splined downhole vibration tool 100 with a helical splined downhole vibration tool 100, wherein the helical splined vibration tool is set-up with pressure pulses of smaller magnitude than the pulses set-up with the straight splined tool, the additional pump open area available to the helical splined tool may produce a pulsing extension force of similar or greater magnitude than the straight splined tool despite utilizing a smaller pulsing pressure.

Figure 15A:
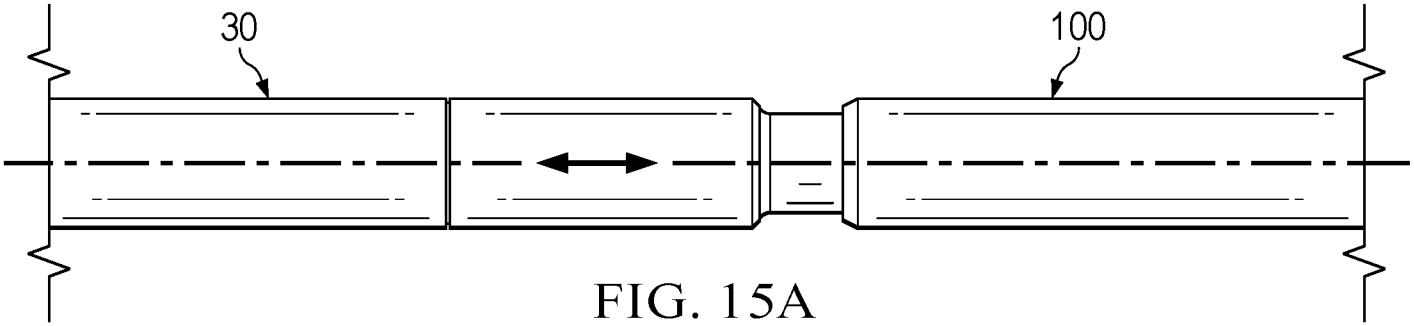
FIG. 15A depicts a side view of a downhole tool consistent with at least one embodiment of the present disclosure.
Figure 15B:
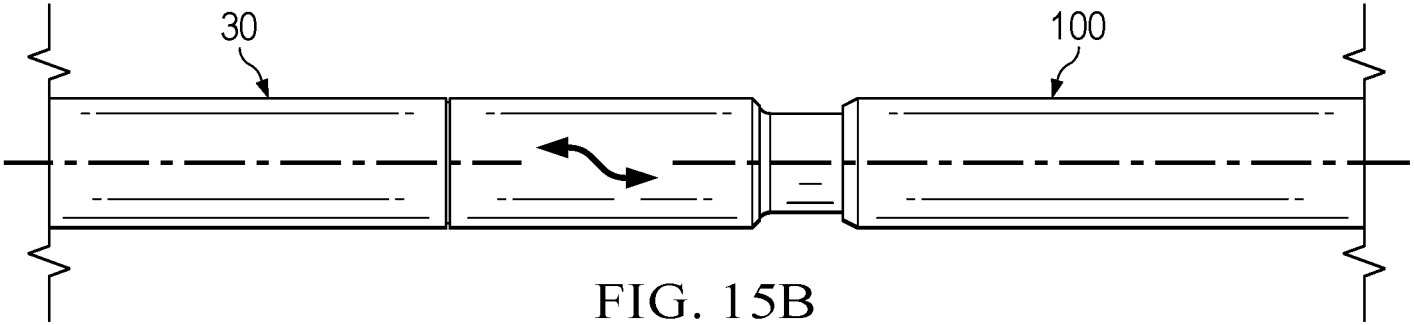
FIG. 15B depicts a side view of a downhole tool consistent with at least one embodiment of the present disclosure.

Downhole vibration tool 100 configured with a helical spline may provide improvements for non-rotary sliding applications. In such applications a tool configured with a straight spline may produce longitudinal axial stroking vibrations as depicted FIG. 15A, a tool configured with a helical spline may produce a compound of axial and rotational stroking vibrations or torsional vibrations as depicted FIG. 15B.

Furthermore, downhole vibration tool 100 configured with a helical spline for rotary applications taking advantage of maximum pump open area, may generate torsional vibrations of magnitude such as to have a percussive effect on the bit, which may increase rate of penetration. In some embodiments, increased stroking force that is cyclically downward and torsional and downhole vibration tool 100 is positioned within the lower region of BHA 17, a percussive action may be applied to drill bit 16.

In some embodiments, if pressure pulsation tool 30 is configured with a control mechanism that is configured such that the pulses can be switched on or off as desired, downhole vibration tool 100 may be selectively switched between a torsional pulsing tool or a torsional absorber tool.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A downhole vibration tool comprising:

a body, the body being generally tubular, the body having one or more helical slots formed on an inner surface thereof;

a mandrel, the mandrel being generally tubular, the mandrel having a bore, the mandrel positioned at least partially within the body, the mandrel having one or more helical splines formed on an outer surface of the mandrel, the helical splines engaging the helical slots of the body, the space between the body and the mandrel wherein the helical splines are located defining a spline chamber, the mandrel translatable axially relative to the body;

a spring, the spring positioned in an annular space formed between the mandrel and the body defined as a spring chamber; and a balance piston, the balance piston positioned in an annular space formed between the mandrel and the body, wherein the balance piston separates an oil-filled chamber from an internal pressure chamber, the internal pressure chamber fluidly coupled to the bore of the mandrel by a balance port, the balance piston movable axially relative to the mandrel and the body wherein the oil filled chamber, spring chamber, and spline chamber are fluidly coupled.

2. The downhole vibration tool of claim 1, wherein the oil-filled chamber, spring chamber, and spline chamber are filled with oil.

3. The downhole vibration tool of claim 1, wherein the body further comprises an upper body spring stop and a lower body spring stop, and wherein the mandrel further comprises an upper mandrel spring stop and a lower mandrel spring stop, such that the spring is compressed between the upper body spring stop and the lower mandrel spring stop when the mandrel moves axially into the body and the spring is compressed between the upper mandrel spring stop and the lower body spring stop when the mandrel moves axially out of the body.

4. The downhole vibration tool of claim 1, wherein the balance piston is configured to move axially in response to movement of the mandrel relative to the body such that the pressure of the oil-filled chamber remains substantially equal to the pressure in the internal pressure chamber.

5. The downhole vibration tool of claim 1, wherein the mandrel further comprises a piston, the piston positioned in an annular space between the mandrel and the body defined as an actuation chamber, the piston dividing the actuation chamber into an external pressure actuation chamber and an internal pressure actuation chamber, wherein the body comprises an external port formed therein that fluidly couples the external pressure actuation chamber to the exterior of the body and wherein the internal pressure actuation chamber is fluidly coupled to the pressure within the bore of the mandrel.

6. The downhole vibration tool of claim 5, wherein the internal pressure actuation chamber is fluidly coupled to the bore of the mandrel by an internal port formed in the mandrel.

7. The downhole vibration tool of claim 5, wherein the mandrel further comprises a second piston, the second piston positioned in a second annular space between the mandrel and the body defined as a second actuation chamber, the second piston dividing the second actuation chamber into a second external pressure actuation chamber and a second internal pressure actuation chamber, wherein the body comprises a second external port formed therein that fluidly couples the second external pressure actuation chamber to the exterior of the body and wherein the second internal pressure actuation chamber is fluidly coupled to the pressure within the bore of the mandrel.

8. The downhole vibration tool of claim 7 wherein the mandrel further comprises a third piston, the third piston positioned in a third annular space between the mandrel and the body defined as a third actuation chamber, the third piston dividing the second actuation chamber into a third external pressure actuation chamber and a third internal pressure actuation chamber, wherein the body comprises a third external port formed therein that fluidly couples the third external pressure actuation chamber to the exterior of the body and wherein the third internal pressure actuation chamber is fluidly coupled to the pressure within the bore of the mandrel.

9. The downhole vibration tool of claim 1, wherein the spring is a Belleville spring.

10. A system comprising:

a drill string, the drill string having a bore;

a downhole vibration tool, the downhole vibration tool including:

a body, the body being generally tubular, the body having one or more helical slots formed on an inner surface thereof, the body coupled to the drill string;

a mandrel, the mandrel being generally tubular, the mandrel having a bore fluidly coupled to the bore of the drill string, the mandrel positioned at least partially within the body, the mandrel having one or more helical splines formed on an outer surface of the mandrel, the helical splines engaging the helical slots of the body, the space between the body and the mandrel wherein the helical splines are located defining a spline chamber, the mandrel translatable axially relative to the body;

a spring, the spring positioned in an annular space formed between the mandrel and the body defined as a spring chamber; and a balance piston, the balance piston positioned in an annular space formed between the mandrel and the body, wherein the balance piston separates an oil-filled chamber from an internal pressure chamber, the internal pressure chamber fluidly coupled to the bore of the mandrel by a balance port, the balance piston movable axially relative to the mandrel and the body wherein the oil filled chamber, spring chamber, and spline chamber are fluidly coupled; and a pressure pulsation tool, the pressure pulsation tool adapted to generate pressure pulses within the bore of the drill string in response to fluid flow through the drill string.

11. The system of claim 10, wherein the oil-filled chamber, spring chamber, and spline chamber are filled with oil.

12. The system of claim 10, wherein the body further comprises an upper body spring stop and a lower body spring stop, and wherein the mandrel further comprises an upper mandrel spring stop and a lower mandrel spring stop, such that the spring is compressed between the upper body spring stop and the lower mandrel spring stop when the mandrel moves axially into the body and the spring is compressed between the upper mandrel spring stop and the lower body spring stop when the mandrel moves axially out of the body.

13. The system of claim 10, wherein the balance piston is configured to move axially in response to movement of the mandrel relative to the body such that the pressure of the oil-filled chamber remains substantially equal to the pressure in the internal pressure chamber.

14. The system of claim 10, wherein the mandrel further comprises a piston, the piston positioned in an annular space between the mandrel and the body defined as an actuation chamber, the piston dividing the actuation chamber into an external pressure actuation chamber and an internal pressure actuation chamber, wherein the body comprises an external port formed therein that fluidly couples the external pressure actuation chamber to the exterior of the body and wherein the internal pressure actuation chamber is fluidly coupled to the pressure within the bore of the mandrel.

15. The system of claim 14, wherein the internal pressure actuation chamber is fluidly coupled to the bore of the mandrel by an internal port formed in the mandrel.

16. The system of claim 14, wherein the mandrel further comprises a second piston, the second piston positioned in a second annular space between the mandrel and the body defined as a second actuation chamber, the second piston dividing the second actuation chamber into a second external pressure actuation chamber and a second internal pressure actuation chamber, wherein the body comprises a second external port formed therein that fluidly couples the second external pressure actuation chamber to the exterior of the body and wherein the second internal pressure actuation chamber is fluidly coupled to the pressure within the bore of the mandrel.

17. The system of claim 10, wherein the spring is a Belleville spring.

18. The downhole vibration tool of claim 10 wherein the pressure pulsation tool includes a control mechanism configured such that the pulses can be switched on or off as desired, whereby the downhole vibration tool can be selectively switched between a torsional pulsing tool or a torsional absorber tool.

19. A method comprising:

coupling a downhole vibration tool to a drill string, the downhole vibration tool comprising:

a body, the body being generally tubular, the body having one or more helical slots formed on an inner surface thereof, the body coupled to the drill string;

a mandrel, the mandrel being generally tubular, the mandrel having a bore fluidly coupled to the bore of the drill string, the mandrel positioned at least partially within the body, the mandrel having one or more helical splines formed on an outer surface of the mandrel, the helical splines engaging the slots of the body, the space between the body and the mandrel wherein the helical splines are located defining a spline chamber, the mandrel translatable axially relative to the body, the mandrel further including a piston, the piston positioned in an annular space between the mandrel and the body defined as an actuation chamber, the piston dividing the actuation chamber into an external pressure actuation chamber and an internal pressure actuation chamber, wherein the body comprises an external port formed therein that fluidly couples the external pressure actuation chamber to the exterior of the body and wherein the internal pressure actuation chamber is fluidly coupled to the pressure within the bore of the mandrel;

a spring, the spring positioned in an annular space formed between the mandrel and the body defined as a spring chamber; and a balance piston, the balance piston positioned in an annular space formed between the mandrel and the body, wherein the balance piston separates an oil-filled chamber from an internal pressure chamber, the internal pressure chamber fluidly coupled to the bore of the mandrel by a balance port, the balance piston movable axially relative to the mandrel and the body wherein the oil filled chamber, spring chamber, and spline chamber are fluidly coupled;

positioning the downhole vibration tool within a wellbore;

causing the mandrel to move helically relative to the body by increasing the pressure within the bore of the mandrel so as to impart a differential pressure across the piston such that the piston exerts an extending force on the mandrel relative to the body.

20. The method of claim 17, further comprising:

helically retracting the mandrel relative to the body by lowering the pressure within the bore of the mandrel so as to impart a differential pressure across the piston such that the piston exerts a longitudinal retraction force and torsional force on the mandrel relative to the body.

21. The method of claim 20, further comprising:

generating a torsional and longitudinal vibration with the downhole vibration tool.

22. The method of claim 19, further including the step of coupling a pressure pulsation tool to the drillstring, wherein the pressure pulsation tool is adapted to generate pressure pulses within the bore of the drill string in response to fluid flow through the drill string.

23. The method tool of claim 22 wherein the pressure pulsation tool includes a control mechanism configured such that the pulses can be switched on or off as desired, whereby the downhole vibration tool can be selectively switched between a torsional pulsing tool or a torsional absorber tool.

24. The method tool of claim 23, further including the step of switching the downhole vibration tool between a torsional pulsing tool or a torsional absorber tool.

25. The method of claim 19 wherein the oil-filled chamber, spring chamber, and spline chamber are filled with oil.

26. The method of claim 19 wherein the body further comprises an upper body spring stop and a lower body spring stop, and wherein the mandrel further comprises an upper mandrel spring stop and a lower mandrel spring stop, such that the spring is compressed between the upper body spring stop and the lower mandrel spring stop when the mandrel moves axially into the body and the spring is compressed between the upper mandrel spring stop and the lower body spring stop when the mandrel moves axially out of the body.

27. The method of claim 19 wherein the balance piston is configured to move axially in response to movement of the mandrel relative to the body such that the pressure of the oil-filled chamber remains substantially equal to the pressure in the internal pressure chamber.

28. The method of claim 19 wherein the mandrel further comprises a piston, the piston positioned in an annular space between the mandrel and the body defined as an actuation chamber, the piston dividing the actuation chamber into an external pressure actuation chamber and an internal pressure actuation chamber, wherein the body includes an external port formed therein that fluidly couples the external pressure actuation chamber to the exterior of the body and wherein the internal pressure actuation chamber is fluidly coupled to the pressure within the bore of the mandrel.

29. The method of claim 19 wherein the internal pressure actuation chamber is fluidly coupled to the bore of the mandrel by an internal port formed in the mandrel.

30. The method of claim 19 wherein the mandrel further comprises a second piston, the second piston positioned in a second annular space between the mandrel and the body defined as a second actuation chamber, the second piston dividing the second actuation chamber into a second external pressure actuation chamber and a second internal pressure actuation chamber, wherein the body comprises a second external port formed therein that fluidly couples the second external pressure actuation chamber to the exterior of the body and wherein the second internal pressure actuation chamber is fluidly coupled to the pressure within the bore of the mandrel.

* * * * *